US010589515B2

(12) United States Patent
Stowe et al.

(10) Patent No.: US 10,589,515 B2
(45) Date of Patent: Mar. 17, 2020

(54) CLEANING SYSTEM ARCHITECTURE WITH RECIRCULATING BATH FOR VARIABLE DATA LITHOGRAPHIC PRINTING

(71) Applicant: PALO ALTO RESEARCH CENTER INCORPORATED, Palo Alto, CA (US)

(72) Inventors: Timothy D. Stowe, Alameda, CA (US); Gregory B. Anderson, Emerald Hills, CA (US); Martin J. Sheridan, Redwood City, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 308 days.

(21) Appl. No.: 15/244,841

(22) Filed: Aug. 23, 2016

(65) Prior Publication Data

US 2018/0056645 A1 Mar. 1, 2018

(51) Int. Cl.

| | |
|---|---|
| ***B41F 35/06*** | (2006.01) |
| ***B41F 35/02*** | (2006.01) |
| ***B41F 7/02*** | (2006.01) |
| *B41M 1/08* | (2006.01) |

(52) U.S. Cl.

CPC ..... *B41F 35/06* (2013.01); *B41F 7/02* (2013.01); *B41F 35/02* (2013.01); *B41M 1/08* (2013.01); *B41P 2227/70* (2013.01); *B41P 2235/22* (2013.01); *B41P 2235/31* (2013.01); *B41P 2235/50* (2013.01)

(58) Field of Classification Search

None

See application file for complete search history.

(56) References Cited

U.S. PATENT DOCUMENTS

| | | | | |
|---|---|---|---|---|
| 5,861,364 | A * | 1/1999 | Beers | B41N 3/06 510/174 |
| 9,156,248 | B1 * | 10/2015 | Thayer | B41F 35/04 |
| 9,365,063 | B1 * | 6/2016 | Thayer | B41J 2/17563 |
| 2005/0136238 | A1 * | 6/2005 | Lindsay | A47L 13/16 428/304.4 |
| 2005/0178281 | A1 | 8/2005 | Berg et al. | |
| 2012/0103212 | A1 * | 5/2012 | Stowe | B41C 1/1041 101/147 |
| 2012/0103221 | A1 | 5/2012 | Stowe et al. | |
| 2015/0378263 | A1 | 12/2015 | Stowe et al. | |
| 2016/0075129 | A1 * | 3/2016 | Becker | B41F 35/06 134/6 |

FOREIGN PATENT DOCUMENTS

| | | | |
|---|---|---|---|
| EP | 2450190 | A1 | 5/2012 |

* cited by examiner

*Primary Examiner* — Joshua D Zimmerman

(74) *Attorney, Agent, or Firm* — Caesar Rivise, PC

(57) ABSTRACT

A variable lithographic cleaning apparatus, system and method works on the principle that dust and ink residue may be transferred from a lower surface energy reimageable conformable blanket surface to a higher surface energy surface low durometer cleaning member, such as the tacky roller, and then to an even higher surface energy cleaning member, such as the hard roller, which is hard and robust to scratching. The hard roller can then been scrubbed clean by an ink flushing device having a third cleaning member, such as a melamine sponge, wetted with a cleaning solution with the hard roller dried upon each rotation.

19 Claims, 2 Drawing Sheets

CLEANING SYSTEM ARCHITECTURE WITH RECIRCULATING BATH FOR VARIABLE DATA LITHOGRAPHIC PRINTING

FIELD OF DISCLOSURE

The disclosure relates to variable data lithographic printing. In particular, the disclosure relates to cleaning methods and systems for use in variable data lithographic printing systems.

BACKGROUND

Offset lithography is a common method of printing today. (For the purposes hereof, the terms "printing" and "marking" are interchangeable.) In a typical lithographic process, an image transfer element or imaging plate, which may be a flat plate-like structure, the surface of a cylinder, or belt, etc., is configured to have "image regions" formed of hydrophobic and oleophilic material, and "non-image regions" formed of a hydrophilic material. The image regions are regions corresponding to the areas on the final print (i.e., the target substrate) that are occupied by a printing or marking material such as ink, whereas the non-image regions are the regions corresponding to the areas on the final print that are not occupied by said marking material. The hydrophilic regions accept and are readily wetted by a water-based fluid, commonly referred to as a fountain solution or dampening fluid (typically consisting of water and a small amount of alcohol as well as other additives and/or surfactants to, for example, reduce surface tension). The hydrophobic regions repel fountain solution and accept ink, whereas the fountain solution formed over the hydrophilic regions forms a fluid "release layer" for rejecting ink. Therefore, the hydrophilic regions of the imaging plate correspond to unprinted areas, or "non-image areas", of the final print.

The ink may be transferred directly to a substrate, such as paper, or may be applied to an intermediate surface, such as an offset (or blanket) cylinder in an offset printing system. In the latter case, the offset cylinder is covered with a conformable coating or sleeve with a surface that can conform to the texture of the substrate, which may have surface peak-to-valley depth somewhat greater than the surface peak-to-valley depth of the imaging blanket. Sufficient pressure is used to transfer the image from the blanket or offset cylinder to the substrate.

The above-described lithographic and offset printing techniques utilize plates which are permanently patterned with the image to be printed (or its negative), and are, therefore, useful only when printing a large number of copies of the same image (long print runs), such as magazines, newspapers, and the like. These methods do not permit printing a different pattern from one page to the next (referred to herein as variable printing) without removing and replacing the print cylinder and/or the imaging plate (i.e., the technique cannot accommodate true high speed variable printing wherein the image changes from impression to impression, for example, as in the case of digital printing systems).

Efforts have been made to create lithographic and offset printing systems for variable data. Examples are disclosed in U.S. Patent Application Publication No. 2012/0103212 A1 (the '212 Publication) published May 3, 2012, based on U.S. patent application Ser. No. 13/095,714, and U.S. Patent Application Publication No. 2012/0103221 A1 (the '221 Publication) also published May 3, 2012 based on U.S. patent application Ser. No. 13/095,778. These applications are commonly assigned, and the disclosure of both are hereby incorporated by reference herein in their entirety, in which an intense energy source such as a laser is used to pattern-wise evaporate a fountain solution. The '212 publication discloses a family of variable data lithography devices that use a structure to perform both the functions of a traditional imaging plate and of a traditional blanket to retain a patterned fountain solution of dampening fluid for inking, and to delivering that ink pattern to a substrate. The '221 publication discloses fundamentals of cleaning ink or paper residue off of the digital blanket on each and every pass. While these publications described architectures that use the general principle of a tacky roller, i.e., a higher surface energy roller to pick off ink and paper dust from the blanket, many practical issues often limit these architectures in terms of speed and cleaning efficiency.

It would be beneficial to provide optimized cleaning systems that show exceptional cleaning potential regardless of speed and ink coverage. The inventors, aided by careful empirical testing and materials analysis, found and prescribe specific materials and system layout guidelines for efficient cleaning of a variable data lithography apparatus.

SUMMARY

The following presents a simplified summary in order to provide a basic understanding of some aspects of one or more embodiments or examples of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later. Additional goals and advantages will become more evident in the description of the figures, the detailed description of the disclosure, and the claims.

The foregoing and/or other aspects and utilities embodied in the present disclosure may be achieved by providing an apparatus and method of variable data lithographic cleaning that works on the principle that dust and ink residue may be transferred from a lower surface energy reimageable conformable blanket surface to a higher surface energy surface low durometer cleaning member, such as the tacky roller, and then to an even higher surface energy cleaning member, such as the hard roller, which is hard and robust to scratching. The hard roller can then been scrubbed clean by an ink flushing device having a third cleaning member, such as a melamine sponge, wetted with a cleaning solution with the hard roller dried upon each rotation.

According to aspects illustrated herein, a variable data lithography cleaning apparatus includes a first cleaning member and a second cleaning member, and an ink flushing device. The first cleaning member has a surface layer with a durometer at most 45 shore A, a surface roughness Ra less than 20 micro inches and a surface energy of 29-35 dynes/cm, which is considered a medium surface energy. The first cleaning member is configured to rotate against a conformable surface of a rotating imaging member, which typically has a low surface energy under 25 dynes/cm, to transfer residual ink from the imaging member to the surface layer of the first cleaning member upon rotation of the imaging member. The second cleaning member has a hard surface with a surface roughness Ra less than 10 micro inches and a surface energy at least 8 dyne/cm higher than the surface energy of the first cleaning member, which is considered a high surface energy. The second cleaning member is configured to rotate against the first cleaning member surface layer to transfer the residual ink from the first cleaning member to the second cleaning member upon rotation of the first cleaning member.

The cleaning apparatus may include an ink flushing device having a melamine sponge disposed in a liquid bath of cleaning solution against the hard surface of the second cleaning member to remove the residual ink from the second cleaning member to the cleaning solution. The melamine sponge is configured to scrub the residual ink from the rotating second cleaning member against the sponge while lubricating the surface of the second cleaning member with the cleaning solution.

An exemplary method of variable data lithographic cleaning includes rotating a first cleaning member having a surface layer with a durometer at most 45 shore A, a surface roughness Ra less than 20 micro inches and a surface energy of 29-35 dynes/cm against a conformable surface of a rotating imaging member to transfer residual ink from the imaging member to the surface layer of the first cleaning member upon rotation of the imaging member, the first cleaning member rotating opposite the imaging member, rotating a second cleaning member having a hard surface with a surface roughness Ra less than 10 micro inches and a surface energy at least 8 dyne/cm higher than the surface energy of the first cleaning member against the first cleaning member surface layer to transfer the residual ink from the first cleaning member to the second cleaning member upon rotation of the first cleaning member, the second cleaning member rotating opposite the first cleaning member.

The exemplary method may include urging a melamine sponge disposed in a liquid bath of cleaning solution against the hard surface of the second cleaning member to remove the residual ink from the second cleaning member to the cleaning solution, the sponge scrubbing the residual ink from the rotating second cleaning member against the sponge while lubricating the surface of the second cleaning member with the cleaning solution.

Exemplary embodiments are described herein. It is envisioned, however, that any system that incorporates features of apparatus and systems described herein are encompassed by the scope and spirit of the exemplary embodiments.

BRIEF DESCRIPTION OF THE DRAWINGS

Various exemplary embodiments of the disclosed apparatuses, mechanisms and methods will be described, in detail, with reference to the following drawings, in which like referenced numerals designate similar or identical elements, and.

DETAILED DESCRIPTION

Figure 1:
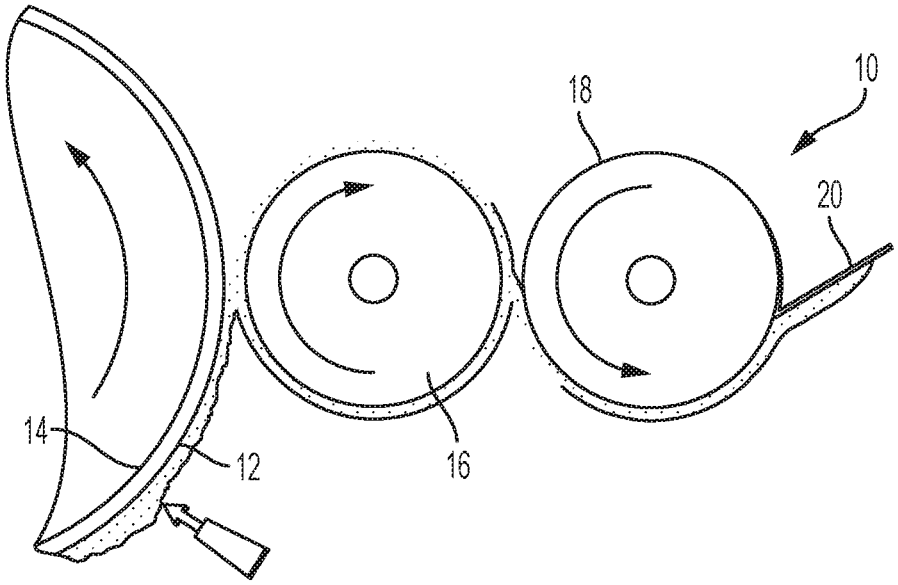
FIG. 1 RELATED ART
FIG. 1 is a side view of a related art variable lithographic cleaning system.

Illustrative examples of the devices, systems, and methods disclosed herein are provided below. An embodiment of the devices, systems, and methods may include any one or more, and any combination of, the examples described below. This invention may, however, be embodied in many different forms and should not be construed as limited to the embodiments set forth below. Rather, these exemplary embodiments are provided so that this disclosure will be thorough and complete, and will fully convey the scope of the invention to those skilled in the art. Accordingly, the exemplary embodiments are intended to cover all alternatives, modifications, and equivalents as may be included within the spirit and scope of the apparatuses, mechanisms and methods as described herein.

We initially point out that description of well-known starting materials, processing techniques, components, equipment and other well-known details may merely be summarized or are omitted so as not to unnecessarily obscure the details of the present disclosure. Thus, where details are otherwise well known, we leave it to the application of the present disclosure to suggest or dictate choices relating to those details. The drawings depict various examples related to embodiments of illustrative methods, apparatus, and systems for inking from an inking member to the reimageable surface.

The modifier "about" used in connection with a quantity is inclusive of the stated value and has the meaning dictated by the context (for example, it includes at least the degree of error associated with the measurement of the particular quantity). When used with a specific value, it should also be considered as disclosing that value.

Although embodiments of the invention are not limited in this regard, the terms "plurality" and "a plurality" as used herein may include, for example, "multiple" or "two or more". The terms "plurality" or "a plurality" may be used throughout the specification to describe two or more components, devices, elements, units, parameters, or the like. For example, "a plurality of resistors" may include two or more resistors.

When referring to any numerical range of values herein, such ranges, are understood to include each and every number and/or fraction between the stated range minimum and maximum. For example, a range of 0.5-6% would expressly include all intermediate values of 0.6%, 0.7%, and 0.9%, all the way up to and including 5.95%, 5.97%, and 5.99%. The same applies to each other numerical property and/or elemental range set forth herein, unless the context clearly dictates otherwise.

The terms "print media", "print substrate" and "print sheet" generally refers to a usually flexible physical sheet of paper, polymer, Mylar material, plastic, or other suitable physical print media substrate, sheets, webs, etc., for images, whether precut or web fed.

The term "printing device" or "printing system" as used herein refers to a digital copier or printer, scanner, image printing machine, xerographic device, electrostatographic device, digital production press, document processing system, image reproduction machine, bookmaking machine, facsimile machine, multi-function machine, or generally an apparatus useful in performing a print process or the like and can include several marking engines, feed mechanism, scanning assembly as well as other print media processing units, such as paper feeders, finishers, and the like. A "printing system" may handle sheets, webs, substrates, and the like. A printing system can place marks on any surface, and the like, and is any machine that reads marks on input sheets; or any combination of such machines.

All physical properties that are defined hereinafter are measured at 20° to 25° C. unless otherwise specified. Hot temperature rheology refers to rheology at about 60° C. and above. Lower temperature rheology refers to rheology at about 40° C. and below. The term "room temperature" refers to 25° C. unless otherwise specified.

Following transfer of the majority of ink from an imaging member to print media during variable lithographic printing, any residual ink and residual fountain solution must be removed from the reimageable surface layer of the imaging member, preferably without scraping or wearing that conformable surface. Most of the fountain solution can be removed quickly, for example, by using an air knife with sufficient air flow. However some amount of ink residue may still remain. This ink residue must be removed to prevent ghosting on subsequent printings.

Removal of this ink residue may be accomplished by the related art cleaning system 10 shown in FIG. 1. The '221 Publication describes details of such a cleaning system 10 including a first cleaning member such as a sticky roller 16 in physical contact with the reimageable surface 12 of the imaging member 14, the sticky roller removing residual ink and any remaining small amounts of surfactant compounds from the fountain solution of the reimageable surface of the imaging member. The sticky roller 16 may then be brought into contact with a smooth roller 18 to which residual ink may be transferred from the sticky roller. The ink is generally stripped from the smooth roller 18 by, for example, a doctor blade 20.

Figure 2:
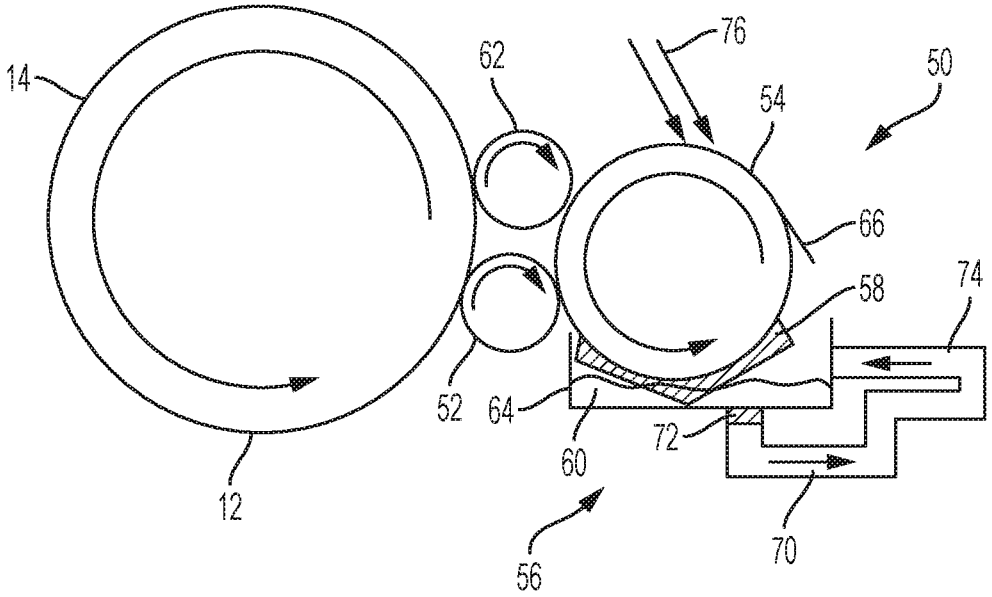
FIG. 2 is a side view of a variable lithographic cleaning system in accordance with an example of the embodiments.

FIG. 2 depicts a cleaning system 50 of the exemplary embodiments, including a series of rollers configured to remove residual products, including non-transferred residual ink and/or remaining fountain solution from the reimageable conformable blanket surface 12 of a variable data lithography imaging member 14 in a manner that is intended to prepare and condition the blanket surface of the imaging member to repeat an image transfer cycle for image transfer in a variable digital data image forming operation. The series of rollers may include at least one first cleaning member, such as tacky roller 52, and a second cleaning member, such as hard roller 54. The cleaning system may also include an ink flushing device 56 that removes the residual products from the rollers.

The cleaning system 50 works on the principle that dust and ink residue may be transferred from a lower surface energy reimageable conformable blanket surface to a higher surface energy surface low durometer roller, such as the tacky roller 52, and then to an even higher surface energy roller, such as the hard roller 54, which is hard and robust to scratching. The hard roller 54 can then been scrubbed clean by the ink flushing device 56 having a third cleaning member, such as a sponge 58, wetted with a cleaning solution 60, with the hard roller dried completely upon each rotation.

The tacky roller 52 is shown in physical contact with reimageable surface layer 12 of the imaging member 14. While shown and described as a roller, tacky roller 52 may be a plate, belt, etc. Tacky roller 52 has a high surface adhesion and pulls ink residue and any remaining (small) amounts of surfactant compounds from the dampening solution off the reimageable surface layer 12.

While not being limited to a particular theory, the inventors found that for a imaging member reimageable surface layer energy in the low surface energy range of 20-25 dynes/cm, the tacky roller 52 can adequate transfer particulates and ink residue with a surface energy in the range of 30 dynes/cm or higher. The tacky roller surface layer material is a low durometer (e.g., less than about 40 Shore A) with an ultralow surface roughness (e.g., Ra less than about 10 micron inches). Low surface roughness may be obtained by casting the tacky roller surface to a smooth shell or by micro-polishing recipes designed to minimize surface roughness average (Ra) for low durometer materials. This ensures the tacky roller surface has maximum contact with the imaging member reimageable surface layer.

The tacky roller surface may also have low ink penetration and swelling for long term reliability. In the examples, the tacky roller is covered with a tacky rubber or elastomer surface layer. In an example the surface layer is Ethylene Propylene Diene Terpolymer (EPDM), which the inventors found works exceptionally well as a low durometer material. In other examples the surface layer includes EPDM alloyed and hybrid rubber materials as well as a polyurethane-like material called TRUST, available from Techno Roll of Japan. While not being limited to a particular material, the exemplary materials have exceptionally low swelling from UV acrylates in UV ink yet also have low durometer.

In the examples, an additional first cleaning member, such as tacky roller 62, may also be used in physical contact with the reimageable surface layer 12 of the imaging member. The second low durometer tacky roller 62 is substantially similar to the first low durometer tacky roller 52 and configured to pick up ink residue from the surface of the digital imaging member blanket that may still remain on the blanket after the first tacky roller 52.

Still referring to FIG. 2, tacky rollers 52, 62 can be brought into contact with a second cleaning member, such as the hard roller 54, having a relatively hard, smooth surface and high surface energy, such as a ceramic, hard steel, chrome, etc., which continuously splits off part of the ink residue from the tacky rollers. To clean off material from the tacky rollers, the hard roller 54 has a higher surface energy which may cause a transfer of ink residue off of the tacky rollers as the rollers rotate against each other. Since the hard roller has a hard smooth surface, it may be scraped clean, for example, under a cleaning solution without damaging the hard surface.

While not being limited to a particular theory, the surface energy of the hard roller 54 may have a high surface energy at least 8-10 dynes/cm higher than the surface energy of the tacky rollers 52, 62 to ensure transfer from the tacky rollers to the hard roller. By example, tacky rollers 52, 62 with surface layers including EPDM may have a medium surface energy (e.g., about 29-35 dynes/cm). Thus the hard roller 54 may be formed of or have a surface layer formed of a material, such as polymers (e.g., ebonite, polyimide, nylon), hard metals (e.g., copper, annealed nickel, tungsten carbide) or hard ceramics that may have high surface energies (e.g., above 42 dynes/cm). In particular the hard roller 54 may have a high surface energy at least between 43-60 dynes/cm. These materials are hard enough to be scraped clean under the pressure of a sponge without causing scratches. Further, the hard roller material should not swell or have micro-cracks of micro-pores.

The inventors have also found that controlling the temperature of the first and second cleaning members helps to remove the ink from the imaging member surface. In the example of FIG. 2, the tacky rollers 52, 62 and hard roller 54 may have their temperature controlled inside of or adjacent the rollers to place the rollers at a temperature below the imaging member 14. The rollers may be cooled, for example, via liquid flow through channels inside the rollers, as well understood by a skilled artisan. While not being limited to a particular theory, the rollers 52, 54, 62 may be controlled (e.g., cooled) to a temperature at least 5 degrees cooler than the temperature of the imaging member 14 to improve ink transfer from the imaging member to the tacky rollers, 52, 62, and from the tacky rollers to the hard roller 54.

Another material factor for adequate cleaning is the efficiency of the sponge 58 for scraping ink from the hard roller 54 surface. While not being limited to a particular theory, the exemplary sponge material is designed hard enough to microscopically loosen ink for the surface of the hard roller 54, yet conformal to the hard roller surface to ensure that all areas of the surface microscopically get wiped. In addition the exemplary sponge is intentionally designed to allow cleaning solution to easily permeate through the sponge to provide lubrication such that frictional heating caused by the hard roller rotating against the sponge is not an issue. In addition, the exemplary sponge may not have surface materials that are harder than the surface of the hard roller 54 to avoid scratching the surface of the roller during interaction. The inventors found that exemplary sponges 58 made of micro porous melamine foam satisfies these requirements with high latitude and is also cost effective. Examples of the micro porous melamine foam sponge material are available under the trade name Magic Eraser. In addition to effectively scrubbing and cleaning the hard roller 54 surface, the micro porous melamine foam sponge 58 allows inks (e.g., UV inks) to diffuse readily through it in a liquid cleaning solution.

FIG. 2 shows the ink flushing device 56 having the sponge 58 dipped in cleaning solution 60 contained in a liquid reservoir or tub 64. The tub 64 may hold the cleaning solution 60 in a liquid bath in liquid communication with the sponge 58 to continuously supply the sponge with the cleaning solution. As the hard roller 54 rotates, for example via a servo motor, the sponge scrubs ink off of the hard roller surface, with the cleaning solution 60 diffused through the sponge to aid in cleaning the surface of the hard roller while lubricating the surface against friction. The sponge 58 may be sized to have an engagement length with the hard roller 54 of not less than 100 mm, which is beneficial for higher speed cleaning at print speeds of at least 1 m/s. In other words, the sponge 58 is sized tor constant scrubbing engagement with the hard roller over at least 100 mm of the circumferential surface of the hard roller.

Once the sponge 58 and cleaning solution has cleaned hard roller 54, the surface of the hard roller may be dried on the fly in order to receive more ink residue and paper dust. Failure to dry the hard roller surface may lead to film splitting between the tack rollers 52, 62 and the hard roller 54, which may impede the migration of the desired ink residue. A squeegee blade 66 may be configured to contact a surface of the hard roller 54 beyond the sponge 58 and dry the hard roller surface upon each rotation. The squeegee blade 66 may include a flexible low durometer hydrophilic material, such as microporous nitrile butadiene rubber (NBR), if water based cleaning solution 60 is used, and thus the hydrophilic squeegee blade 66 may wick away the cleaning solution from the surface of the hard roller 54. Alternatively if other cleaning solution chemistries are used, the squeegee blade may be made of other materials (e.g., fluorocarbon, viton, TEFLON) designed to efficiently wick away the type of cleaning solution used.

While not being limited to a particular theory, the cleaning solution 60 may be water based to effectively clean the hard roller surface. While other solvents will readily work they are not necessarily VOC free and many solvents have health exposure concerns. In order to ensure adequate wetting of low surface energy UV ink formulations, a surfactant may be added to the aqueous solution. This surfactant may not leave residue once dried on the hard roller to eliminate concerns of cleaning solution transferring back to the tacky rollers 52, 62 or the conformable imaging member surface 12, because such contamination could lead to imaging defects. In the examples, the surfactants due not plate out of the cleaning solution when water is dried but instead plate back into the cleaning solution thus leaving little or no measurable residue or contamination. The surfactant may be an anionic surfactant (e.g., Bio-soft D40). The surfactant may be a cleaner available under the trade name Liquinox.

Air flow may be used via an air dryer 76 or continued rotation of the hard roller 54 to further remove or evaporate any remaining surface moisture. As well understood by a skilled artisan, temperature control (e.g., heating) of the hard roller may be beneficial as well to remove remaining surface moisture as well. Friction can also cause some heating. Preferably the temperature of the hard roller 54 remains at least 5 degrees cooler than the temperature of the imaging member 14. Too low a temperature can cause the ink to harden and be difficult to smash, scrape and transfer.

It should be noted that surfaces such as chrome or porous alumina are not preferred for the hard roller, at least because these surfaces may not perform adequately over long print runs as water or oils can enter into these pores and be difficult to remove. Therefore, the hard surface material in the examples is preferably pore free, microscopic crack free, and smooth with a Ra less than 10 microinches.

During the cleaning operation of the ink flushing device 56, the sponge 58 scrubs ink off of the hard roller surface. The ink transfers to the sponge and migrates with the cleaning solution through the sponge into the liquid bath contained in the tub 64. At some point, the cleaning solution may become over saturated with the ink residue. The ink flushing device 56 may include a recycling system 68 including a flush pipe or conduit 70 that may drain the inked cleaning solution from the tub 64, a filter 72 to trap ink residue and dust from the inked cleaning solution, and a recycle conduit 74 that returns the filtered cleaning solution back into the tub. The filter 72 may be cleaned as needed to prevent ink clogging, for example by removing the filter from the recycling system 68 and rinsing the ink off of the filter. The filter 72 may also be replaced by a clean filter as desired to ensure adequate filtering of the ink from the cleaning solution. With the recycling system 68, change out of the cleaning solution can be very infrequent with low maintenance, thereby reducing serving and operating costs. The tub 64 may be considered part of the flush conduit 70 or the recycle conduit 74.

Figure 3:
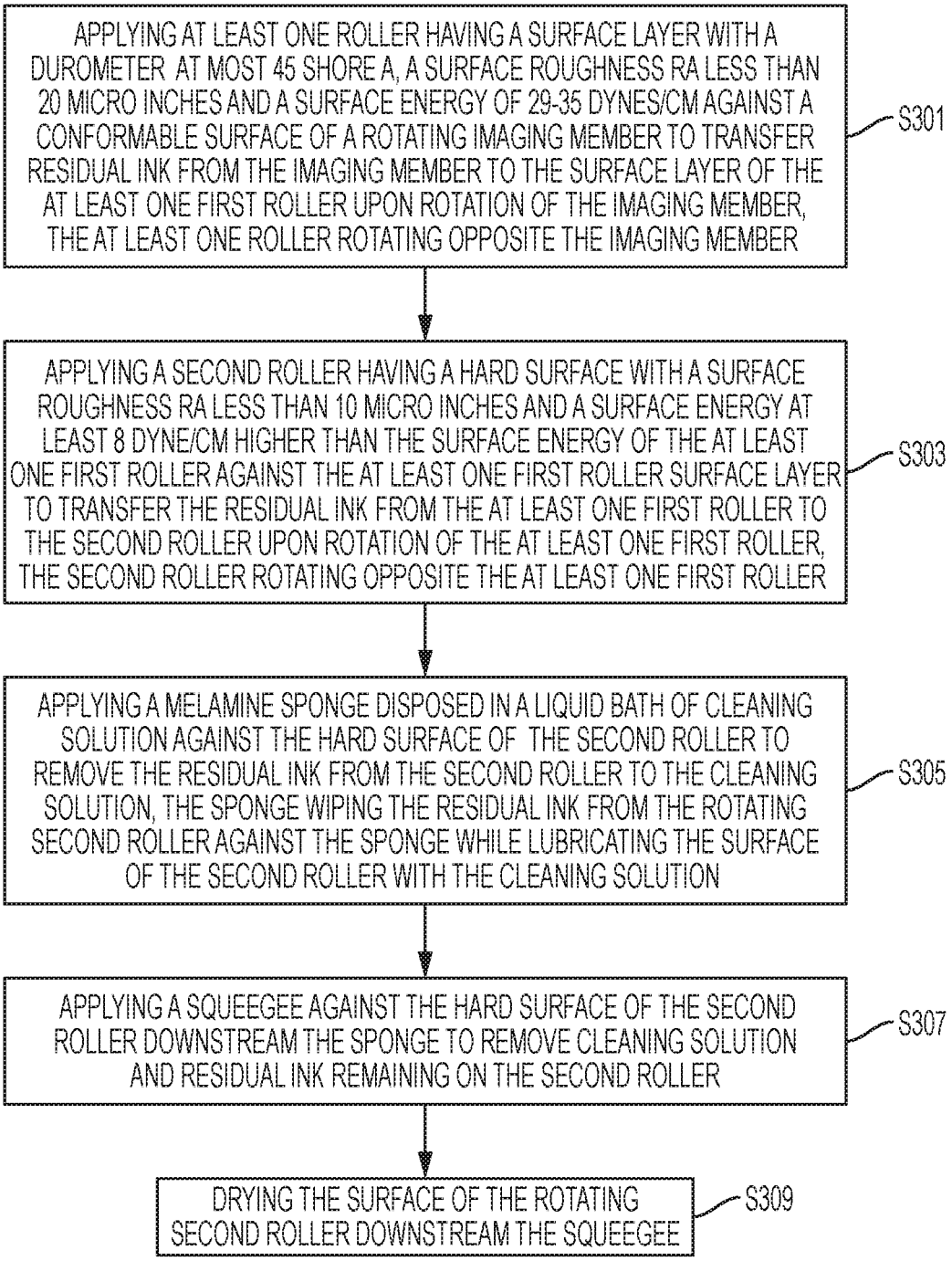
FIG. 3 shows a variable lithographic cleaning process in accordance with an exemplary embodiment.

FIG. 3 shows methods for variable lithographic cleaning in accordance with an embodiment. Specifically, methods for cleaning may include rotating at least one first cleaning member (e.g., tacky roller 52, 62) having a surface layer with a durometer at most 45 shore A, a surface roughness Ra less than 20 micro inches and a medium surface energy (e.g., about 29-35 dynes/cm) against a reimageable conformable surface 12 of a rotating imaging member 14 to transfer residual ink from the imaging member to the surface layer of the at least one first cleaning roller upon rotation of the imaging member, the at least one first cleaning member rotating opposite the imaging member, at Step S301. The tacky roller surface may have low ink penetration and swelling for long term reliability. Further, the tacky roller may be covered with a tacky rubber or elastomer surface layer. In an example, the surface layer is Ethylene Propylene Diene Terpolymer (EPDM). In other examples, the surface layer includes EPDM alloyed and hybrid rubber materials as well as a polyurethane-like material called TRUST, available from Techno Roll of Japan.

At Step S303, a second cleaning member (e.g., hard roller 54) having a hard surface with a surface roughness Ra less than 10 micro inches and a high surface energy at least 8 dyne/cm higher than the medium surface energy of the at least one first cleaning member is rotated against the at least one first cleaning member (e.g., tacky roller 52, 62) to transfer the residual ink from the at least one first cleaning member to the second cleaning member upon rotation of the at least one first cleaning member, the second cleaning member rotating opposite the at least one first cleaning member. The hard roller 54 may be formed of or have a surface layer formed of a material, such as polymers (e.g., ebonite, polyimide, nylon), hard metals (e.g., copper, annealed nickel, tungsten carbide) or hard ceramics that may have intrinsic surface energies at least 8-10 dynes/cm higher than the surface energy of the at least one first cleaning member to ensure transfer to the second cleaning member. This step may also include rotating the at least one first cleaning member against the second cleaning member to effectuate the residual ink transfer. Motors, such as servo motors may attach to one or more of the cleaning members to rotate the members.

Methods for variable lithographic cleaning may include urging a sponge (e.g., melamine foam sponge 58) disposed in a liquid bath of cleaning solution 60 into a scraping relationship against the hard surface of the second cleaning member (e.g., hard roller 54) to remove the residual ink from the second cleaning member to the cleaning solution, the sponge conforming against the second cleaning member and wiping the residual ink from the rotating second cleaning member against the sponge while lubricating the surface of the second cleaning member with the cleaning, at Step S305. This step may include rotating the second cleaning member against the abutting sponge to allow the sponge to scrape the residual ink from the second cleaning member. This step may also include transferring the cleaning solution from the liquid bath to the second cleaning member to help clean the surface of the second cleaning member and provide lubrication between the rotating second cleaning member and the relatively fixed sponge.

At Step S307, a squeegee (e.g., squeegee blade 66, wick) is applied against the hard surface of the rotating second cleaning member adjacent and rotationally downstream the sponge to remove any cleaning solution and residual ink remaining on the second cleaning member after Step S305. The squeegee may be a squeegee blade made of a flexible low durometer hydrophilic material. The exemplary cleaning methods may also include drying the surface of the rotating second cleaning member that has passed the squeegee (e.g., rotationally downstream the squeegee) via an air dryer 76, as well understood by a skilled artisan, at Step S309.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. A variable data lithographic printing system cleaning apparatus, comprising:

a first cleaning member having a surface layer with a durometer at most 45 shore A, a surface roughness Ra less than 20 micro inches and a medium surface energy higher than a low surface energy of an imaging member, the first cleaning member configured to rotate against a conformable surface of the imaging member to transfer residual ink from the imaging member to the surface layer of the first cleaning member upon rotation of the imaging member;

a second cleaning member having a hard surface with a surface roughness less than the surface roughness of the first cleaning member and a high surface energy higher than the surface energy of the first cleaning member, the second cleaning member configured to rotate against the first cleaning member surface layer to transfer the residual ink from the first cleaning member to the second cleaning member upon rotation of the first cleaning member; and an ink flushing device including a melamine sponge disposed in a liquid bath of cleaning solution against the hard surface of the second cleaning member to remove the residual ink from the second cleaning member to the cleaning solution, the melamine sponge configured to scrub the residual ink from the rotating second cleaning member against the sponge while lubricating the surface of the second cleaning member with the cleaning solution, wherein the melamine sponge is stationarily fixed in the liquid bath of cleaning solution against the hard surface of the second cleaning member to remove the residual ink from the second cleaning member.

2. The variable data lithographic printing system cleaning apparatus of claim 1, further comprising a squeegee against the hard surface of the second cleaning member rotationally downstream the melamine sponge, the squeegee configured to remove cleaning solution and residual ink remaining on the second cleaning member after the second cleaning member is scrubbed by the melamine sponge.

3. The variable data lithographic printing system cleaning apparatus of claim 1, further comprising a filter configured to separate the residual ink from the cleaning solution.

4. The variable data lithographic printing system cleaning apparatus of claim 1, further comprising a recycling system coupled to the liquid bath of cleaning solution, the recycling system including a filter configured to separate the residual ink from the cleaning solution, and a conduit recycling the filtered cleaning solution back to the liquid bath.

5. The variable data lithographic printing system cleaning apparatus of claim 1, wherein the second member is a hard roller having a high surface energy, and the melamine sponge is configured for constant scrubbing engagement with the hard roller over at least 100 mm of the circumferential surface of the hard roller.

6. The variable data lithographic printing system cleaning apparatus of claim 1, further comprising an air dryer proximate the second cleaning member rotationally downstream the melamine sponge to remove any surface moisture from the hard surface of the second cleaning member after the second cleaning member is scrubbed by the melamine sponge.

7. The variable data lithographic printing system cleaning apparatus of claim 1, the first cleaning member having a temperature controlled to a temperature at least 5 degrees C. less than the temperature of the imaging member, the second cleaning member having a temperature controlled to a temperature at least 5 degrees C. less than the temperature of the imaging member.

8. The variable data lithographic printing system cleaning apparatus of claim 1, wherein the first cleaning member is a tacky roller having an ethylene propylene diene terpolymer surface with a surface energy of 29-35 dynes/cm and in rolling contact with both the imaging member and the second cleaning member, and the second cleaning member is a hard roller having a surface roughness Ra less than 10 micro inches and a high surface energy at least 8 dyne/cm higher than the surface energy of the tacky roller, the hard roller having a surface including one of ebonite, copper, nickel, polyimide, or nylon.

9. The variable data lithographic printing system cleaning apparatus of claim 1, wherein the first cleaning member includes a first tacky roller and a second tacky roller, the first tacky roller being in rolling contact with both the imaging member and the second cleaning member, the second tacky roller being in rolling contact with both the imaging member and the second cleaning member adjacent the first tacky roller and configured to transfer ink residue from the surface of the imaging member to the second cleaning member that may still remain on the surface of the imaging member after the first tacky roller.

10. A method of cleaning using the variable data lithographic printing system cleaning apparatus of claim 1, comprising:

rotating the first cleaning member against the conformable surface of the imaging member to transfer residual ink from the imaging member to the surface layer of the first cleaning member upon rotation of the imaging member, the first cleaning member rotating opposite the imaging member;

rotating the second cleaning member against the first cleaning member surface layer to transfer the residual ink from the first cleaning member to the second cleaning member upon rotation of the first cleaning member, the second cleaning member rotating opposite the first cleaning member; and urging the melamine sponge disposed in the liquid bath of cleaning solution against the hard surface of the second cleaning member to remove the residual ink from the second cleaning member to the cleaning solution, the sponge scrubbing the residual ink from the rotating second cleaning member against the sponge while lubricating the surface of the second cleaning member with the cleaning solution.

11. The method of claim 10, further comprising fixing the melamine sponge in a stationary position in the liquid bath of cleaning solution against the hard surface of the second cleaning member to remove the residual ink from the second cleaning member.

12. The method of claim 10, further comprising:

urging a squeegee against the hard surface of the second cleaning member rotationally downstream the sponge to remove cleaning solution and residual ink remaining on the second cleaning member surface after it is scrubbed by the melamine sponge;

drying the surface of the rotating second cleaning member rotationally downstream the melamine sponge.

13. The method of claim 12, wherein the urging the melamine sponge disposed in the liquid bath of cleaning solution against the hard surface of the second cleaning member includes rotating the second cleaning member against the abutting sponge to allow the sponge to scrape the residual ink from the second cleaning member.

14. The method of claim 10, further comprising separating the residual ink from the cleaning solution with a filter and recycling the cleaning solution back to the liquid bath.

15. The method of claim 10, wherein the urging the melamine sponge disposed in the liquid bath of cleaning solution against the hard surface of the second cleaning member includes transferring the cleaning solution from the liquid bath to the second cleaning member to help clean the surface of the second cleaning member and provide lubrication between the rotating second cleaning member and the relatively fixed sponge.

16. The method of claim 10, further comprising controlling the temperature of both the first cleaning member and the second cleaning member to a temperature less than the temperature of the imaging member.

17. The method of claim 10, wherein the rotating a first cleaning member includes rotating a first tacky roller and a second tacky roller, the first tacky roller being in rolling contact with both the imaging member and the second cleaning member, the second tacky roller being in rolling contact with both the imaging member and the second cleaning member adjacent the first tacky roller and configured to transfer ink residue from the surface of the imaging member to the second cleaning member that may still remain on the surface of the imaging member after the first tacky roller.

18. The method of claim 10, wherein the first cleaning member is a tacky roller having an ethylene propylene diene terpolymer surface with a surface energy of 29-35 dynes/cm and in rolling contact with both the imaging member and the second cleaning member, and the second cleaning member is a hard roller having a surface roughness Ra less than 10 micro inches and a high surface energy at least 8 dyne/cm higher than the surface energy of the tacky roller, the hard roller having a surface including one of ebonite, copper, nickel, polyimide, or nylon.

19. A variable data lithographic printing system cleaning system, comprising:

a first cleaning member having a surface layer with a durometer at most 45 shore A, a surface roughness Ra less than 20 micro inches and a surface energy of 29-35 dynes/cm, the first cleaning member configured to rotate against a conformable surface of a rotating imaging member to transfer residual ink from the imaging member to the surface layer of the first cleaning member upon rotation of the imaging member, the first cleaning member having a temperature controlled to a temperature less than the temperature of the imaging member;

a second cleaning member having a hard surface with a surface roughness Ra less than 10 micro inches and a surface energy at least 8 dyne/cm higher than the surface energy of the first cleaning member, the second cleaning member configured to rotate against the first cleaning member surface layer to transfer the residual ink from the first cleaning member to the second cleaning member upon rotation of the first cleaning member, the second cleaning member having a temperature controlled to a temperature less than the temperature of the imaging member, the first cleaning member having a temperature controlled to a temperature at least 5 degrees C. less than the temperature of the imaging member, the second cleaning member having a temperature controlled to a temperature at least 5 degrees C. less than the temperature of the imaging member;

an ink flushing device including a melamine sponge disposed in a liquid bath of cleaning solution against the hard surface of the second cleaning member to remove the residual ink from the second cleaning member to the cleaning solution, the melamine sponge configured to scrub the residual ink from the rotating second cleaning member against the sponge while lubricating the surface of the second cleaning member with the cleaning solution, the melamine sponge being stationarily fixed in the liquid bath of cleaning solution against the hard surface of the second cleaning member to remove the residual ink from the second cleaning member; and a fluid removal unit proximate the second cleaning member rotationally downstream the melamine sponge to remove the cleaning solution remaining on the second cleaning member surface after the second cleaning member is scrubbed by the melamine sponge, wherein the first cleaning member includes a first tacky roller and a second tacky roller, the first tacky roller being in rolling contact with both the imaging member and the second cleaning member, the second tacky roller being in rolling contact with both the imaging member and the second cleaning member adjacent the first tacky roller and configured to transfer ink residue from the surface of the imaging member to the second cleaning member that may still remain on the surface of the imaging member after the first tacky roller.

* * * * *